US005429361A

United States Patent [19]

Raven et al.

[11] Patent Number: 5,429,361

[45] Date of Patent: Jul. 4, 1995

[54] GAMING MACHINE INFORMATION, COMMUNICATION AND DISPLAY SYSTEM

[75] Inventors: Richard Raven; Thomas Miner; Jay Stone, all of Reno, Nev.

[73] Assignee: Bally Gaming International, Inc., Las Vegas, Nev.

[21] Appl. No.: 763,924

[22] Filed: Sep. 23, 1991

[51] Int. Cl.[6] ..... A63F 9/24

[52] U.S. Cl. ..... 273/138 A

[58] Field of Search ..... 273/138 A, 143 R, 138 R, 273/85 CP, 85 G, 434, DIG. 28, 269; 364/410, 412

[56] References Cited

U.S. PATENT DOCUMENTS

| | | | |
|---|---|---|---|
| 4,072,930 | 2/1978 | Lucero et al. . | |
| 4,157,829 | 6/1979 | Goldman et al. | 273/138 A |
| 4,339,798 | 7/1982 | Hedges et al. . | |
| 4,494,197 | 1/1985 | Troy . | |
| 4,575,622 | 3/1986 | Pellegrini . | |
| 4,594,663 | 6/1986 | Nagata . | |
| 4,636,951 | 1/1987 | Harlick . | |
| 4,650,977 | 3/1987 | Couch . | |
| 4,652,998 | 3/1987 | Koza . | |
| 4,669,596 | 6/1987 | Capers . | |
| 4,669,730 | 6/1987 | Small . | |
| 4,675,515 | 6/1987 | Lucero . | |
| 4,689,742 | 8/1987 | Troy . | |
| 4,805,907 | 2/1989 | Hagiwara | 273/138 A |
| 4,815,741 | 3/1989 | Small . | |
| 4,856,787 | 8/1989 | Itkis | 273/269 |
| 4,889,339 | 12/1989 | Okada . | |
| 4,969,183 | 11/1990 | Reese . | |
| 4,991,848 | 2/1991 | Greenwood . | |
| 5,038,022 | 8/1991 | Lucero . | |
| 5,113,990 | 5/1992 | Gabrius et al. | 273/138 A |
| 5,179,517 | 1/1993 | Sarbin et al. | 364/410 |
| 5,197,094 | 3/1993 | Tillery et al. | 379/91 |

FOREIGN PATENT DOCUMENTS

| | | | |
|---|---|---|---|
| 132715/78 | 2/1979 | Australia . | |
| 134427/78 | 9/1979 | Australia . | |
| 20270/83 | 3/1984 | Australia . | |
| 21573/83 | 7/1984 | Australia . | |
| 0360613A2 | 3/1990 | European Pat. Off. . | |
| 3406058 | 8/1985 | Germany | 273/138 A |
| WO91/20150 | 12/1991 | WIPO . | |

OTHER PUBLICATIONS

Sarbin U.S. application Serial No. 07/247,983 filed Sep. 22, 1988

*Primary Examiner*—Jessica J. Harrison

*Attorney, Agent, or Firm*—Jenner & Block

[57] ABSTRACT

An information and communication system permits communication between gaming machines and a central control system and between a player or operator and a central control system. The system includes a central data processor, a control unit for each gaming machine within the system which is in communication with the central data processor and a user interface which includes a keypad, a card reader and a display. A user interface is secured to each gaming machine and operatively connected to the control unit. The keypad can be used by a player or operator to transmit information to the central data processor. The control unit can be used to identify special players and transmits messages, including promotional messages, for display. The control unit includes memory which contains personality data for the gaming machine and can be used to transmit the personality data from the user interface to its memory. The control unit can accept personality data from a card inserted into the card reader and can be enabled by a personal identification number entered on the keypad. The system provides multiple features including automated maintenance, game accounting, security, player tracking, event tracking, employee/player interaction from the game to the central data processor, cashless operation of gaming machines, reserving gaming machines and other functions.

28 Claims, 2 Drawing Sheets

GAMING MACHINE INFORMATION, COMMUNICATION AND DISPLAY SYSTEM

TECHNICAL FIELD

The invention relates to the field of amusement and gaming machines, and in particular to a method and system for permitting such gaming machines to communicate with a central control system, allowing the player or operator to communicate with the system, and permitting cashless operation of such gaming machines.

BACKGROUND OF THE INVENTION

Gambling casinos and other establishments often have large numbers of individual gaming machines, such as slot machines and video gaming machines. For some time it has been desirable to automate accounting, security and other functions related to such machines for efficiency, reliability and economy. Data transfer systems for providing accounting and security information to casino operators have been described in U.S. Pat. Nos. 4,072,930, 4,283,709 and 4,636,951. The systems known in the art, however, have been principally directed toward reporting data from the gaming machines to the central computer, and have not provided for transmission of data from the central computer to the individual machines. Further, such systems have not provided any means by which a player or employee can communicate with the system. Another disadvantage of these systems is that their functions have been very limited, primarily for reporting accounting data to the central computer.

In the past it has not been possible for a player to interrupt his play, leave the machine briefly, and then return and resume play. It is desirable to provide a reservation feature so that a player can temporarily reserve a machine.

It is also desirable to permit cashless gaming so that the player does not need to carry large sums of cash or obtain change in different denominations for the different machines he wishes to play. A gaming system using credit cards wherein approval and credit is provided by a remote financial institution is disclosed in U.S. Pat. No. 5,038,022. However, that system does not permit winnings to be credited directly to a player's card or account, and contemplates the involvement of a third-party bank or other financial institution.

SUMMARY OF THE INVENTION

It is therefore an object of the invention to provide a system for automating maintenance, accounting, security, player tracking, event recording and other functions for a plurality of gaming machines.

It is a further object of the invention to provide a system including display and data entry means which permit the player or employee to interact with the system.

It is a further object of the invention to provide a cashless gaming system in which the player may play a plurality of gaming machines using a single card in lieu of cash, and his winnings may be directly credited to his card.

It is a further object of the invention to provide a means for a player to temporarily reserve a gaming machine.

It is another object of the invention to provide a signal to casino personnel to identify special players.

It is yet another object of the invention to provide for the downloading of data from the central data processor to the individual gaming machines.

DETAILED DESCRIPTION OF THE INVENTION

SYSTEM HARDWARE AND OPERATION

Figure 1:
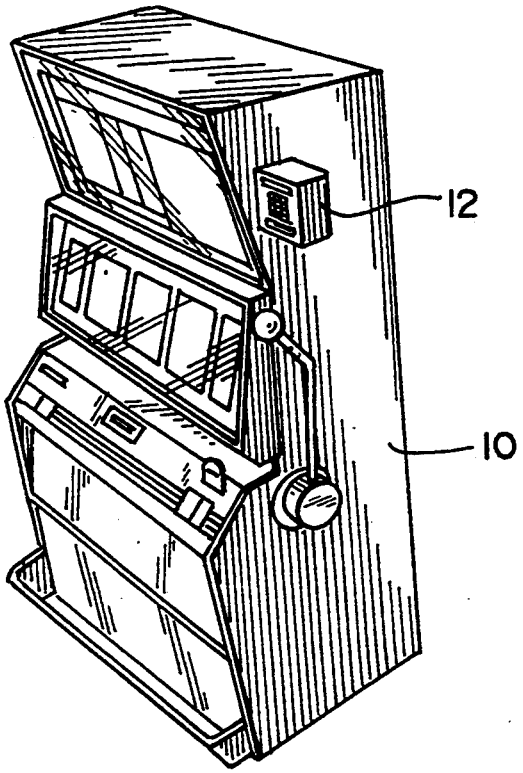
FIG. 1 is a perspective view of a gaming machine.
Figure 2:
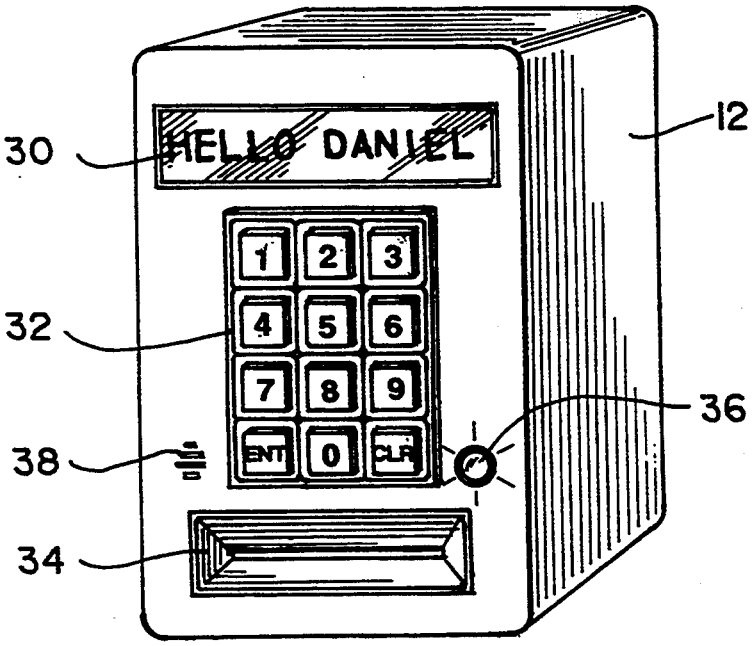
FIG. 2 is a perspective view of the display, multiple card reader and keypad unit for use on each gaming machine in the system.

The system of the invention provides multiple features including game accounting, security, maintenance, player tracking and employee/player interaction from the game to the computer. The gaming machine 10 shown in FIG. 1 includes the present invention which provides these functions and features. The system of the invention is designed to be flexible and compatible with existing gaming machines and systems. FIG. 2 shows the display, multiple card reader and keypad (DMK) unit 12 which is mounted on the cabinet of the gaming machine 10 of FIG. 1. The DMK 12 is the only portion of the system accessible to the player.

Figure 3:
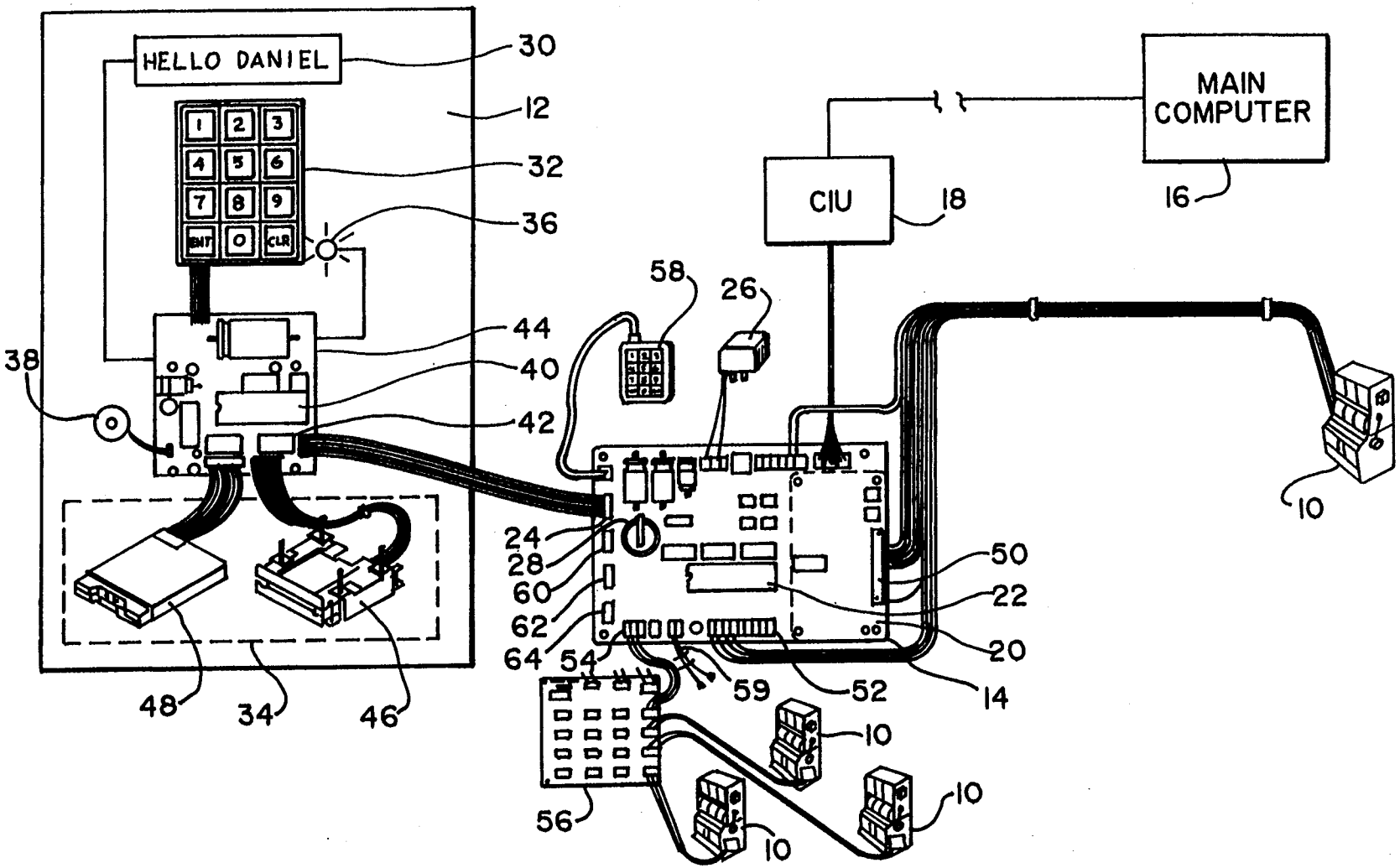
FIG. 3 is a functional block diagram of the system of the invention.

As shown in FIG. 3, the primary hardware elements of this system are a control unit called the MASTERCOM 14; a DMK unit 12; and a main computer 16. A MASTERCOM 14 is required for each gaming machine 10 in the system, and a DMK unit 12 is needed for each gaming machine 10 for which the display, card reader and employee/player communications features are desired.

The main (or host) computer 16 may be a personal computer, for example, an IBM RT class or compatible, or a minicomputer such as a DEC 1184 or IBM RISC 6000, depending on the size of the installation and the number of gaming machines. The main computer 16 may also consist of two or more such computers linked together. The main computer 16 is located remotely in the casino, preferably in a secured area, and communicates with the MASTERCOM units 14 via a computer interface unit (CIU) 18.

The term MASTERCOM is derived from its functions: Maintenance, Accounting, Security, player Tracking, Event Recorder, Communicator. In the preferred embodiment, the MASTERCOM 14 is contained on a single circuit board 20 which has a microprocessor or microcontroller 22 such as the Motorola MC68HC705C8 microcontroller. The board 20 also contains memory including random access memory (RAM) and some form of read-only memory (ROM), such as EEPROM. Typically, a 128-byte EEPROM may be used for storing game personality data, and a 32-byte EEPROM may be used for storing the accounting meters. The MASTERCOM 14 is connected to the DMK 12 via a serial port 24. The MASTERCOM board 20 is fairly compact (on the order of 4.5×6.5 inches) and may be conveniently located inside the gaming machine cabinet 10. The MASTERCOM 14 is powered by an external power supply 26. A 10-year lithium battery 28 is provided to back-up the RAM.

The DMK 12 is the interface and communications device between a player or employee and the MASTERCOM 14. The DMK unit 12 may be mounted directly in the gaming machine cabinet 10 or attached to an existing cabinet as shown in FIG. 1. As shown in FIG. 2, the DMK 12 houses a 12-character dot-matrix LED display 30, a 12-key user interface keypad 32, and a combined magnetic/smart card reader 34. In the preferred embodiment shown in FIG. 2, it also includes a three-color LED 36 for special customer identification, and a small sound module 38 for alerting the player to an important message. Like the MASTERCOM 14, the DMK 12 is controlled by a microprocessor 40, using, for example, a Motorola MC68HC705C8S. The DMK 12 receives power from the MASTERCOM 14. The microprocessor 40 and related circuitry are mounted on a small circuit board 44. The keypad 32 and display 30 may be mounted on the reverse side of the circuit board 44 to save space.

The personality stored in EEPROM is a list of variable parameters containing addresses, coin denomination, limits and characteristics that vary from one gaming machine and/or casino to another. The MASTERCOM 14 and its microprocessor 22 will not function properly unless a valid personality has been installed. On power up, reset and at periodic intervals, the MASTERCOM 14 will test the personality in the EEPROM and determine if it is valid by looking at the check sum. If the personality is invalid (bad check sum) or none exists, the MASTERCOM will display a flashing "EMP CARD" on the DMK 12 and will halt communications with the main computer 16. Only after the problem has been corrected and at least the MASTERCOM address has been entered will the MASTERCOM 14 resume communications with the main computer 16. The address is a four digit number which is converted to a two digit hexadecimal address for the MASTERCOM. This is the address used by the main computer 16 to communicate with the particular MASTERCOM 14 via the CIU 18.

Once an employee card has been inserted into the card reader 34 in response to the "EMP CARD" prompt, the DMK 12 will display a prompt with "ADDR xx" so the employee can immediately enter the personality, beginning with the address, or can command the main computer 16 to download the personality. To manually enter the personality, the employee begins by entering four digits which are the ASCII equivalent of the two digit hexadecimal address as shown in the following table:

| HEX TO ASCII CODES | | | |
|---|---|---|---|
| HEX | ASCII | HEX | ASCII |
| 0 | 30 | 8 | 38 |
| 1 | 31 | 9 | 39 |
| 2 | 32 | A | 41 |
| 3 | 33 | B | 42 |
| 4 | 34 | C | 43 |
| 5 | 35 | D | 44 |
| 6 | 36 | E | 45 |
| 7 | 37 | F | 46 |

After the address has been entered, the display 30 will prompt the employee to enter other variables seriatim, for example, COIN (coin type), MXIN (maximum coin in), etc.

The following elements of the MASTERCOM personality, or operating parameters, may be casino-defined and changed as needed via the DMK keypad 32 as explained in more detail below:

1) Machine system address
2) Machine Paid Jackpot Notification—the minimum size of a machine paid jackpot (in coins) which will produce an exception code (63), which will produce a special change booth message notifying casino personnel of the jackpot so they can refill the machine's coin hopper.
3) Maximum coin in—used by MASTERCOM to verify the jackpot amounts
4) Maximum jackpot number—used in games which communicate serially with the MASTERCOM to define which jackpot codes will be received from the game.
5) Progressive Jackpot Table—a list of which progressive jackpot Ids may be hit on this game.
6) Maximum number of progressive jackpots (available on this game)
7) Minimum number of coins per handle pull required for "Hot Handle"—many games permit multiple coins to be played in a single game, i.e, on one handle pull in a slot machine. If a player repeatedly plays multiple coins, the "hot handle" designation will apply.
8) Number of Handle Pulls for "Hot Player"—number of hot handles needed to generate a hot player message
9) Period of time for Hot Player—amount of time a player has to accumulate the required number of hot handle pulls
10) Reset Time for Hot Player—the amount of time between handle pulls (no play activity) before the Period of Time for Hot Player is reset.
11) Service Button Delay—period of time before a service message is sent; message is sent only if employee has not serviced player and canceled message;
12) Disable Service Button—length of time between enabling service request messages.
13) Time for Employee Card—length of time before producing an abandoned card message for an employee card.
14) Time for Player Card—length of time before producing an abandoned card message for a player card.
15) Starting Amount of Bonus Point Countdown—the reset value for the countdown display; the countdown resets to this value when a different player card is inserted into the card reader or a countdown cycle has occurred.
16) Bonus Point Amount Earned for Each Countdown Cycle—the award amount may be of any multiple or percentage desired.
17) Number of Coins per Bonus Point—the number of coins in required to earn x number of bonus points.
18) Number of Coins per Countdown Amount—the number of coins in required to reduce the countdown amount by x amount.

The personality also contains information for other casino-defined functions, such as the service requests discussed below and the definition of the colors on the three-color LED 36 for indicating special players.

The DMK 12 receives three types of input data: card data read from a card inserted by either a player or employee; keypad entry data from either a player or employee; and display commands from the MASTERCOM 14. The DMK 12 transmits three kinds of data directly to the MASTERCOM 14: card data read from the card reader 34; keypad entry data from the keypad 32; and display command data to inform the MASTERCOM 14 that the DMK 12 is processing the display command that was sent to it. Data is transmitted to and from the MASTERCOM using the Serial Peripheral Interface (SPI) 42. The DMK's SPI 42 is set up as a slave device. The DMK 12 can receive data at a maximum rate of 2.1 Mhz, which has been found to be sufficient for the intended purposes.

The display 30 consists of 12 alphanumeric characters with associated firmware for control. The firmware controls and provides timing and sequencing for the SPI 42, card reader 34, keypad 32 entry, and characters or words displayed. The display 30 receives the various display commands via the SPI 42 from the MASTERCOM 14.

The message types include the following: (1) ROM scrolled message—A message stored in ROM is continuously scrolled across the display 30 when the MASTERCOM 14 is in the "attract" mode, i.e., when the game is not being played or serviced. (2) Down-loaded RAM messages—Special messages such as promotional messages or current sports scores may be downloaded from the system and displayed; (3) Jackpot amount; (4) Hand pay jackpot amount; (5) LED 36 or sound unit 38 control; (6) Bonus information—A player may earn bonus or frequent player points by spending a predetermined amount; (7) Bad communications—messages indicating problems with communicating with the system; and (8) 8- or 12- digit fixed word messages.

The DMK 12 receives several types of display messages from the MASTERCOM 14. The message types are single byte commands, multi-byte commands, and down-loaded messages. The D0-type message is actually a two-byte message: D0 plus a display command byte, which informs the DMK 12 what to display. Some types of display commands are ROM scroll, STANDBY, TRANSMIT, INVALID, etc., each represented by a hexadecimal code.

The D1-type message is a multi-byte message as shown in the following table:

| Byte No. | Message Data |
|---|---|
| 1 | Message type (D1 HEX) |
| 2 | Message Length (HEX, excluding check sum) |
| 3 | Display command (HEX) |
| 4 – n | Message (ASCII) |
| n + 1 | Check sum |

The message length is the number of bytes in the message plus one for the display command. The display command byte informs the DMK 12 the format in which to display the message. The display commands include employee card sequence, bonus points, jackpot with amount, hand paid jackpot with amount, and employee keypad entry prompts. The check sum is the two's complement sum of all the bytes of the message.

There are three basic types of downloaded messages: promotional, sports and player reply. Promotional messages include notices of special events in the casino, special rates and the like. Sports messages give scores of current sporting events for the player's information and entertainment. Player reply messages request the player to enter some requested information.

In addition to the messages sent by the MASTERCOM 14, a poll is sent to the DMK 12 every 100 msec. A poll is a single byte command (80 HEX). After the poll is sent, the DMK 12 should reply with one of three types of messages: status, keypad or card data. The status message is a three-byte message consisting of the following bytes: ASCII S, current display status and current card status. If the display status is not the same as the MASTERCOM's, then the MASTERCOM 14 will retransmit the current display message. After ten tries, the MASTERCOM 14 will reset the DMK 12.

The keypad message is a single-byte message containing the key code of the key pressed. The card data message is a 9-byte message as shown in the following table:

| Byte No. | Message Data |
|---|---|
| 1 | Message type (C1–C8 HEX) |
| 2 | Message length (6 HEX, excludes check sum) |
| 3–8 | Card data (6 HEX bytes) |
| 9 | Check sum |

The message type sent to the MASTERCOM 14 indicates card status as set forth in the following table:

| Code (HEX) | Definition |
|---|---|
| C1 | Good card read with 6 data bytes |
| C2 | Card completely out |
| C3 | Bad card read |
| C4 | No data on card coming out |
| C5 | No data on card coming in |
| C6 | Card is coming out |
| C7 | Rear sensor seen without front sensor |
| C8 | Timeout on card going in or coming out |

The message length is always 6 bytes. The card data contains player or employee information that is stored on the card. The check sum is the two's complement sum of all the bytes in the message.

In the preferred embodiment, the card reader 34 is a combined magnetic and smart (memory) card reader, for example, a combination of the Tatsuno smart card reader 46 and a Neuron magnetic card reader 48. This permits the system to accept both types of cards. Although the magnetic card alone is sufficient for many system functions, the smart card by virtue of its on-board memory permits additional functions, and is especially useful in cashless gaming as described in more detail below.

The magnetic card reader 48 accepts bit stream data from an inserted magnetic card. Four inputs are used to detect the data and card position: front card sensor, rear card sensor, data strobe and data. The data bits are taken in bit by bit on each data strobe input and stored in contiguous memory. There are four records encoded on track 1 of the magnetic stripe of either 15 or 16 character lengths. Each record is preceded by two bytes of zeroes (0) followed by one or two START sentinels ($45), 12 DATA characters, one STOP sentinel ($1F) and a LRC. The LRC is the exclusive OR'd result of all characters from the START sentinel though the STOP sentinel. Each data byte is 7 bits long with the seventh bit being an odd parity bit. This seven bit data is then converted to six (6) hexadecimal data bytes for use by the system (see table below).

The card data characters are set forth in the following table:

| Byte No. | Card Data Character |
|---|---|
| 1 | START sentinel ($45) |
| 2 | START sentinel |

-continued

| Byte No. | Card Data Character |
|---|---|
| 3 | Casino ID number - MSD |
| 4 | Casino ID number - LSD |
| 5 | Employee or player code |
| 6–10 | Customer number |
| 11–14 | Customer/employee number |
| 15 | STOP sentinel ($1F) |
| 16 | LRC |

The raw 7-bit card data is converted to hexadecimal as follows:

| Raw 7 Bit Card Data | Converted Hex Data |
|---|---|
| 100 0101 | 45 (START) |
| 001 0000 | 0 |
| 101 0001 | 1 |
| 101 0010 | 2 |
| 001 0011 | 3 |
| 101 0100 | 4 |
| 001 0101 | 5 |
| 001 0110 | 6 |
| 101 0111 | 7 |
| 101 1000 | 8 |
| 001 1001 | 9 |
| 110 0001 | A |
| 110 0010 | B |
| 010 0011 | C |
| 110 0100 | D |
| 010 0101 | E |
| 010 0110 | F |
| 001 1111 | 1F (STOP) |

If the front card sensor only is seen, indicating card going in or stopped, a timer is started. If no rear sensor is seen after 4 seconds, a code is sent to the MASTERCOM 14 and the timer is reset. The timer is also cleared on card out.

If the rear sensor is seen, indicating card in and seated, the front sensor timer is cleared. If the front sensor has not been seen, a bad front sensor code ($C7) is sent to the MASTERCOM 14. Otherwise, the raw card bit stream data is analyzed. If there is good data on one of the four records, a $C1 code is sent to the MASTERCOM 14. If there is a bad card read, a $C3 code is sent. Raw read data is cleared so the card can be read on the way out. When the rear sensor is no longer seen, indicating that the card is coming out, a $C5 code is sent to the MASTERCOM 14.

If there is no front or rear sensor, the card is out. If there is no raw card data, a $C4 code is sent; if there is card data, a $C2 code is sent.

After the player inserts his card containing good data, a welcome greeting including the player's name is displayed on the display 30 of DMK 12. If applicable, his current accumulated bonus points and amounts needed to play to earn his next bonus paid will then be displayed.

The keypad 32 consists of 12 keys in a 3 by 4 matrix, including the digits 0 through 9, "CLR" (clear) and "ENT" (enter). The keypad 32 is polled every 10 msec. Keypad entries are verified for valid keypad entry by the DMK 12 and then passed directly to the MASTERCOM 14. The keypad codes sent to the MASTERCOM 14 are as follows:

| Code | Key or key combination |
|---|---|
| 11 | 0 |
| 1 | 1 |

-continued

| Code | Key or key combination |
|---|---|
| 2 | 2 |
| 3 | 3 |
| 4 | 4 |
| 5 | 5 |
| 6 | 6 |
| 7 | 7 |
| 8 | 8 |
| 9 | 9 |
| 10 | CLR (Clear) |
| 12 | ENT (Enter) |
| 13 | CLR + ENT (backspace) |

The player may use the keypad 32 to enter his PIN and credit requests for cashless gaming as described below. The player may also use the keypad 32 to request cocktail service, change, or machine service, or to reserve the machine 10. The codes may vary, but may be, for example, 1+ENT for cocktail service, 2+ENT for change, 3+ENT for service, and 4+ENT to reserve the machine 10. Entering the code for cocktail service, change or machine service will send a signal to the system to notify the appropriate employee to respond. The reservation feature is an innovation which allows a player to interrupt his play and return to the machine later, resuming play where he left off. Upon entry of the reservation code, a timer is started and the machine enters the reserved mode in which no other player may use the game. The player then removes his card and may leave the machine. When the player who reserved the game reinserts his card, play may resume. If the player does not return in a predetermined length of time, e.g., 10 minutes, the reservation feature times out and the game returns to the attract mode. The reservation mode may also be canceled by insertion of an employee card into the card reader 34. An employee may also invoke the reservation feature without a time limit.

An employee may use the keypad 32 for a variety of functions not available to players. A valid employee card inserted into the card reader 34 will enable employee keypad entries. The DMK 12 will first display the following series of status messages:

| Display | | Definition |
|---|---|---|
| ADDR | XX | MASTERCOM Address |
| EXCD | XX | Last exception code sent to MASTERCOM |
| BET | XXXX | Last game - amount bet |
| PAY | XXXX | Last game - amount paid |
| PER# | MST1001 | Program (personality) identification |

Upon completion of the sequence, the DMK will prompt with a display of "MODE OO." The sequence may be aborted at any time before reaching MODE 00 by depressing any key on the keypad 32. Removal of the employee card from the card reader 34 will terminate the operational mode routine and return the DMK 12 to normal system operations. The MODE 00 display is the normal entry point for execution of employee operations. The employee enters the desired command and then presses ENT to start the operation. The employee commands are READ PERSONALITY MODE (01), ALTER PERSONALITY MODE (02), TEST MODE (03) and "911" EMERGENCY/MESSAGE TRANSMISSION MODE (91).

The READ PERSONALITY MODE allows the employee to review the personality of the MASTER- COM 14 for a given game. As previously discussed, the personality is a list of variable parameters containing addresses, coin type, limits and characteristics that vary from one game and/or casino to another. The MASTERCOM 14 will not function properly unless a valid personality has been installed. An employee may select READ PERSONALITY MODE directly without authorization from the main computer 16. This mode only allows the employee to review the data without making any changes. By repeatedly pushing the ENT key, the employee can step through each line of personality data. If no personality is installed, or if the personality is invalid, an appropriate message will be displayed.

To enter the ALTER PERSONALITY MODE, the employee must obtain authorization from the main computer 16. This security device prevents unauthorized tampering with the game personality. Once cleared by the main computer 16, the employee may then step through the lines of data using the ENT key, and may enter changes using the keypad 32. The employee may also cause a new personality to be down loaded from the main computer 16.

The TEST MODE causes a self test routine to execute and to report on the display any system problems or errors. In the TEST MODE, all signals received by the MASTERCOM 14 are displayed to insure proper operation of all inputs. The test routine looks at certain flags in the MASTERCOM 14 and displays the trigger status of the discrete inputs as the employee triggers the discrete devices. The exact tests will vary depending on the type of machine personality. The test mode may be selected without main computer 16 authorization.

The EMERGENCY 911 MODE allows an employee to quickly send a request for emergency assistance to casino security in case of a medical or other emergency. The exact location of the game on the casino floor (based on its address) will instantly be provided to security personnel, facilitating a quick response. To enter this mode, the employee will insert his card and at the prompt MODE 00 will enter "91"+ENT. This will transmit an exception code (24) to the main computer 16, requesting that help be sent to the location of the MASTERCOM/DMK. The display 30 will then show "TRANSMIT" to let the employee know the exception code 24 has been transmitted. After the MASTERCOM 14 receives acknowledgement of the transmitted code from the main computer 16, the display 30 will show the message "HELP IS . . . COMING." This display will remain until the employee card is removed.

Other modes which may be provided include an ENTRY mode, in which a two-digit code is displayed to indicate the reason of entry into the game 10, i.e., a door open condition. It is important for a casino operator to keep track of reasons for entry into the game for security and regulatory reasons. In the WORK ORDER mode, an automatic work order is sent to the casino's repair shop when a game is placed out of service.

As previously mentioned, in the preferred embodiment a multi-color LED 36 is provided on the DMK 12. This LED 36 is lighted to indicate to casino personnel that a special player, e.g., a "high roller" or "VIP" is playing the game, and may be worthy of special treatment. The criteria for each color may be defined by the casino, and may be based on data stored on the player's card as well as the amount being played.

As shown in FIG. 3, each MASTERCOM 14 communicates with the main computer 16 via the CIU 18 using balanced line serial communications. Up to approximately 125 or more MASTERCOM units may be hung on a single line, and in a large casino the line may be many hundreds of feet long with.

The MASTERCOM 14 interfaces with the gaming machine 10 by direct wire and/or RS/232 communications 50. Adapters in the form of piggyback circuit boards may be used to interface the MASTERCOM 14 with various types of gaming machines from different manufacturers. The MASTERCOM provides multiple door interfaces 52 for the game, drop, electronic security and auxiliary doors on the gaming machine 10. The MASTERCOM 14 also provides a port 54 for a progressive gaming system link 56.

An optional handheld keypad and display unit 58 is provided for the convenience of employees. This may be especially useful if a DMK unit is not available on a particular gaming machine or is out of service.

A lockout connector 59 is also provided on the MASTERCOM 14. By connecting the MASTERCOM 14 to the coin mechanism of the gaming machine 10, it is possible to lockout, or reject, all coins inserted into the machine.

The MASTERCOM 14 also provides additional high-speed serial ports 60, 62 and 64 for options such as a bill changer interface, a ticket dispenser interface, or cashless gaming control. The bill changer allows the machine to accept currency in addition to coins. The ticket dispenser may be used for various purposes, such as to print a jackpot slip for a hand pay jackpot which can be taken to the cashier at the player's convenience, or to dispense bonus tickets for certain levels of play which may be redeemed in the casino for prizes.

CASHLESS GAMING

An important benefit of the invention is the capability to easily provide completely cashless gaming in several different possible formats. Among the advantages of cashless gaming are that the player need not carry large amounts of cash or obtain change in the correct denominations for each type of machine he wishes to play.

In one embodiment including the cashless gaming feature, a magnetic (credit) card is used. The operating procedure for this "cashless" or "credit card" gaming is as follows. The player inserts his magnetic card into the magnetic 48 or combined magnetic/smart 34 card reader in the DMK 12. Upon detecting the insertion of the card, the DMK 12 will prompt the player by means of the display 30 to enter his personal identification number (PIN) via the keypad 32. After the PIN is entered, the DMK display 30 will ask the player to enter the credit amount desired to be used on the game. The player will enter this amount via the keypad 32. The PIN and credit amount are transmitted to the system for verification (either at a financial institution or at the casino, depending upon the issuer of the magnetic card). If a correct PIN and valid amount have been entered, the main computer 16 will return an authorization amount and a code to the MASTERCOM 14, and the verified amount will be shown on the display. As play proceeds, the credit balance will be updated and displayed in dollars and cents on the display 30.

For convenience, in the preferred embodiment the minimum and maximum amount of credit permitted on each request will be a function of the game denomination. For example, a one roll coin equivalent may be used as the minimum, and five rolls may be used as a maximum. For a quarter (25 cent) machine, one roll of quarters equals $10.00, so the minimum credit request would be $10.00 and the maximum would be $50.00, with amounts in between in $10.00 increments.

Once the credit amount has been verified, the player can proceed with game play. On gaming machines already equipped with credit play capabilities, the player will bet using switches on the gaming machine 10 itself. On older noncredit model machines, a separate BET button may be provided on the DMK unit 12. As play proceeds, the MASTERCOM logic keeps track of credits and debits, and the current balance is shown on the display. When the player is finished playing, he can check his balance on the display 30 and then remove his card. Upon removal of the card, the MASTERCOM 14 will transmit the balance amount to the main computer 16, which in turn will return a message received code. The display 30 will then indicate "VERIFIED" and show the balance recorded by the system, and thereafter will return to the promotional display mode. The player may then proceed at his convenience to the cashier to collect his balance recorded by the system.

In another embodiment including cashless gaming, a "smart" or memory card is used. With this type of card, there is limited system involvement during cashless play. The player purchases from the casino cashier or other source a smart card with a dollar amount credited to the card. This becomes in effect the player's "bank." The player inserts the card into the smart 46 or combined smart/magnetic card 34 reader, and his ID number and the bank balance are sent to the MASTERCOM 14. No credit authorization is required, because the player is carrying his "bank" with him on his card. The player then plays the game in the normal manner. Each bet is subtracted (debited) from his card, and any wins are added (credited) to his card. If the card balance is reduced to zero, the player must remove the card and return to the cashier to purchase more credits for the card.

The smart card is mechanically locked into place in the smart 46 or combined smart/magnetic card reader 34 upon insertion, and remains locked until the player requests removal by pushing a button. At this time, the card balance is updated, and the new balance sent to the MASTERCOM 14.

A smart card may also be used in another embodiment with full system involvement. In this embodiment, the smart card is used in the same manner as a magnetic card. However, the smart card has the added security of carrying the bank balance on the card, which can be cross-checked by the system upon insertion of the card into the reader. The player can request the system to increase his smart card credit amount by debiting his central bank account. This transaction will be subject to verification and approval through the system. Credit amounts can be stored on the smart card and carried from machine to machine. This is a distinct difference from the magnetic card where the credit amounts are stored solely on the system. With the magnetic card, the player must request a transfer of credits from the system each time he inserts his magnetic card.

From the above discussion it is apparent that the invention provides a gaming machine system with multiple features, not only providing the casino operator with extensive information for casino management, but also allowing the player and employee to interact with the system. Although the system has been described in terms of its use with gaming machines which return money to the player, many aspects of the invention would also apply to coin-operated amusement type games.

A specific embodiment of the invention for use with gaming machines in a casino has been described for purposes of illustrating the manner in which the system may be made and used. It should be understood that implementation of other variations and modifications of the invention in its various aspects will be apparent to those skilled in the art, and that the invention is not limited to the specific embodiment described. It is therefore contemplated to cover by the present invention any and all modifications, variations and equivalents that fall within the true scope and spirit of the basic underlying principles disclosed and claimed herein.

We claim:

1. An information and communication system for use with a player controlled gaming machine comprising:

a central data processor;

control means located within said gaming machine for communicating between said central data processor and the gaming machine; and an interface unit, separate and additional to the gaming machine, including a keypad, a card reader and a display secured to the gaming machine and operatively connected to said control means wherein said keypad transmits player generated information to said central data processor.

2. The system of claim 1 wherein said interface unit includes means for a player to reserve the gaming machine by temporarily disabling the gaming machine thereby preventing other players from playing said gaming machine.

3. The system of claim 1 wherein said control means includes means responsive to said interface unit for identifying special players to said central data processor.

4. The system of claim 1 wherein said control means includes means for transmitting from said central data processor messages for display on said display.

5. The system of claim 4 wherein said messages include promotional messages.

6. The system of claim 1 wherein said control means includes a memory containing personality data for the gaming machine and includes transmitting means for transmitting said personality data from said interface unit to said memory.

7. The system of claim 6 wherein said transmitting means accepts said personality data from a card inserted into said card reader.

8. The system of claim 7 wherein said transmitting means is enabled by a personal identification number input through said keypad.

9. An information and communication system for use with a gaming machine comprising:

a central data processor;

control means located within said gaming machine for communicating between said central data processor and the gaming machine; and an interface unit including a keypad, a card reader and a display secured to the gaming machine and operatively connected to said control means, said control means include reservation means for permitting said keypad to be used by a player to reserve the gaming machine.

10. The system of claim 9 wherein the player is identified by a card inserted in said card reader and said card is reinserted to reactivate the gaming machine.

11. An information and communication system for use with a gaming machine comprising:

a central data processor;

control means located within said gaming machine for communicating between said central data processor and the gaming machine; and an interface unit including a keypad, a card reader and a display secured to the gaming machine and operatively connected to said control means wherein said control means is responsive to a card inserted in said card reader to identify special players to said central data processor.

12. An information and communication system for use with a gaming machine comprising:

a central data processor;

control means located within said gaming machine for communicating between said central data processor and the gaming machine; and an interface unit including a keypad, a card reader and a display secured to the gaming machine and operatively connected to said control means wherein said control means includes means for transmitting messages from said central data processor to said display.

13. The system of claim 12 wherein said messages include promotional messages.

14. An information and communication system for use with a gaming machine comprising:

a central data processor;

control means located within said gaming machine for communicating between said central data processor and the gaming machine; and an interface unit including a keypad, a card reader and a display secured to the gaming machine and operatively connected to said control means wherein said control means includes a memory and includes means for transmitting personality data from said card reader to said memory.

15. An information and communication system for use with a gaming machine comprising:

a central data processor;

control means located within said gaming machine for communicating between said central data processor and the gaming machine; and an interface unit including a keypad, a card reader and a display secured to the gaming machine and operatively connected to said control means wherein said control means includes cashless means which responds to a credit card inserted into said card reader for generating a request for a personal identification number to be displayed on said display; receiving a personal identification number and a credit amount from said keypad; transmitting said personal identification and said credit amount to said central data processor and displaying said amount on said display.

16. The system of claim 15 wherein a minimum and a maximum amount of said credit amount increases with the denominations of the gaming machine.

17. The system of claim 15 wherein said credit card contains a credit value and wherein said cashless means includes means for transmitting said credit value on said card to said central data processor when the card is removed from said card reader.

18. The system of claim 15 further including a credit card wherein said credit card is a smart card containing an approved credit amount and said cashless means transfers said approved credit amount to said control means for game play.

19. The system of claim 15 wherein said credit amount must be approved by said central data processor.

20. The system of claim 15 further including a credit card wherein said credit card is a smart card and said cashless means transfers a credit amount which includes the debits and credits incurred during game play to said card when said card is removed from said card reader.

21. The system of claim 15 further including a credit card wherein said credit card is a smart card and said cashless means transfers a credit amount which includes the debits and credits incurred during game play to said card when said card is removed from said card reader.

22. The reservation system of claim 21 wherein said reservation means limits the reservation of the gaming machine to a predetermined amount of time.

23. An information system for use with a gaming machine comprising:

an interface unit including a keypad, a card reader and a display secured to the gaming machine;

control means located within said gaming machine for transmitting information between said interface unit and said gaming machine wherein said control means includes reservation means for permitting a player to use said interface unit to reserve the gaming machine.

24. The system of claim 23 wherein said reservation means responds to a player card in said card reader and a signal from said keypad to reserve the gaming machine.

25. The system of claim 24 wherein the gaming machine is reserved after said player card is removed from said card reader.

26. The system of claim 25 wherein the gaming machine is unreserved when said player card is reinserted in said card reader.

27. The system of claim 23 wherein said reservation means causes the gaming machine to be unreserved after a predetermined amount of time.

28. An information system for use with a gaming machine comprising:

an interface unit including a keypad, a card reader and a display secured to the gaming machine;

control means located within said gaming machine for transmitting information between said interface unit and said gaming machine;

a light source secured to said interface unit responsive to signals from said control means to display a visible signal indicating a predetermined type of player.

* * * * *